US009470382B1

(12) United States Patent
Sharrah et al.

(10) Patent No.: US 9,470,382 B1
(45) Date of Patent: Oct. 18, 2016

(54) PORTABLE LIGHT

(71) Applicant: Streamlight, Inc., Eagleville, PA (US)

(72) Inventors: Jonathan R Sharrah, Phoenixville, PA (US); Mark Snyder, Hockessin, DE (US); Brian Orme, Phoenixville, PA (US)

(73) Assignee: Streamlight, Inc., Eagleville ( * ) Notice: Subject to any disclaimer, the term of this patent is extended or adjusted under 35 U.S.C. 154(b) by 0 days.

(21) Appl. No.: 14/260,369

(22) Filed: Apr. 24, 2014

Related U.S. Application Data

(60) Provisional application No. 61/815,561, filed on Apr. 24, 2013.

(51) Int. Cl.

| | |
|---|---|
| ***F21L 4/00*** | (2006.01) |
| ***F21L 4/02*** | (2006.01) |
| ***F21V 23/04*** | (2006.01) |
| ***F21V 29/00*** | (2015.01) |

(52) U.S. Cl.
CPC ..... *F21L 4/02* (2013.01); *F21V 23/0428* (2013.01); *F21V 29/2212* (2013.01)

(58) Field of Classification Search
USPC ..... 362/157
See application file for complete search history.

(56) References Cited

U.S. PATENT DOCUMENTS

| | | | | |
|---|---|---|---|---|
| 6,474,837 | B1 * | 11/2002 | Belliveau | 362/231 |
| 7,281,826 | B2 * | 10/2007 | Huang | F21V 21/084 362/106 |
| 7,344,270 | B2 * | 3/2008 | Kim | 362/205 |
| 8,120,263 | B2 * | 2/2012 | Lin et al. | 315/209 R |
| 2005/0122714 | A1 * | 6/2005 | Matthews | F21L 4/027 362/206 |
| 2005/0173232 | A1 * | 8/2005 | Horton et al. | 200/11 R |
| 2007/0285925 | A1 * | 12/2007 | Hough | 362/268 |
| 2009/0027876 | A1 | 1/2009 | Yu | |
| 2010/0084249 | A1 * | 4/2010 | Bandy et al. | 200/4 |
| 2011/0122609 | A1 * | 5/2011 | Dahlin | 362/184 |
| 2012/0163005 | A1 * | 6/2012 | Liu | F21S 4/008 362/427 |

FOREIGN PATENT DOCUMENTS

| | | | |
|---|---|---|---|
| DE | WO2012004145 | A1 * | 12/2012 |
| EP | 1880692 | | 1/2008 |
| GB | 598388 | | 2/1948 |
| GB | 2476466 | | 6/2011 |
| WO | 2008/072194 | | 6/2008 |
| WO | 2008/091931 | | 7/2008 |
| WO | 2011/023957 | | 3/2011 |

* cited by examiner

*Primary Examiner* — Jason Moon Han
*Assistant Examiner* — Omar Rojas Cadima
(74) *Attorney, Agent, or Firm* — Dann, Dorfman, Herrell and Skillman; Stephen Eland

(57) ABSTRACT

A portable light having a light head with a plurality of light elements and a rotatable diffuser to selectively diffuse the light produced by the light elements. The diffuser is operable by an actuator. The actuator further includes a switch for controlling the dimming level of the light elements. A separate switch controls whether the light is "on" or "off".

14 Claims, 9 Drawing Sheets

PORTABLE LIGHT

PRIORITY CLAIM

This application claims priority to U.S. Provisional Patent Application No. 61/815,561 filed Apr. 24, 2013. The entire disclosure of the foregoing application is hereby incorporated herein by reference.

FIELD OF THE INVENTION

The present invention relates to the field of portable lights and in particular to battery powered portable lights, such as flashlights and lanterns.

BACKGROUND OF THE INVENTION

Portable lights, such as flashlights and lanterns are regularly used by law enforcement, fire, rescue and other emergency personnel. Although numerous lights have been created for various emergency situations, there exists a need for a high-powered light that is durable, provides flexible lighting and is easy to use.

SUMMARY OF THE INVENTION

In light of the foregoing, according to one aspect, Applicant's invention provides a portable light having a housing and a light head connected with the housing. The light head comprises a plurality of light elements spaced apart from one another and a reflector comprising a plurality of concave reflective surfaces, wherein each light element is disposed within one of the concave reflective surfaces so that the reflective surfaces focus the light from the light element disposed within the respective reflective surface. A displaceable diffuser selectively diffuses the light from the light elements, wherein the diffuser comprises a plurality of first areas having a first dispersal pattern and a plurality of second areas having a second dispersal pattern different from the first pattern. The first and second areas are spaced about the diffuser so that in a first position the first areas of the diffuser overlie the reflectors so that the light from the light elements projects through the first areas, and wherein when the diffuser is in a second position, the second areas of the diffuser overlie the reflectors so that the light from the light elements projects through the second areas. The light further comprises a controller operable to control the light levels of the light elements so that in a first position the light elements provide a full light level and in a second position the light elements provide a dim light level that is less than the light provided by the full light level. An actuator is operable to displace the diffuser from the first position to the second position. The actuator comprises a switch actuable by the actuator, wherein the controller controls the light between the full light level and the dim light level in response to actuation of the switch.

According to another aspect, the present invention provides a portable light, comprising a housing having a compartment for receiving a battery and a light head. The light head comprises a light element, a heat sink and a connector for connecting the light head with the housing. The heat sink comprises a plurality of spaced apart fins for transferring heat from the heat sink and a bridge spanning two of the fins to provide a mounting surface. The connector is connected to the mounting surface bridging the two fins. According to one aspect the connector is pivotable relative to the light head or the housing so that the heat sink is pivotable relative to the housing.

According to yet another aspect, the present invention provides a portable light comprising a housing and an LED. The LED is operable in an "on" condition to provide a first illumination level and a "dim" condition to provide a second illumination level that is dimmer than the first illumination level. A battery within the housing provides power for the light element. The light further comprises a controller for controlling the light element between the "on" condition and the "dim" condition, wherein the controller comprises an LED driver operable to provide a first current to the LED in the "on" condition and a second current to the LED in the "dim" condition. The LED diver also comprises a feedback input connected with the LED and the controller selectively provides a voltage offset so that the current received by the LED driver is the same when the LED is in the "dim" condition as when the LED is in the "on" condition.

BRIEF DESCRIPTION OF THE DRAWINGS

The foregoing summary and the following detailed description of the preferred embodiments of the present invention will be best understood when read in conjunction with the appended drawings, in which.

DETAILED DESCRIPTION OF THE INVENTION

Figure 1:
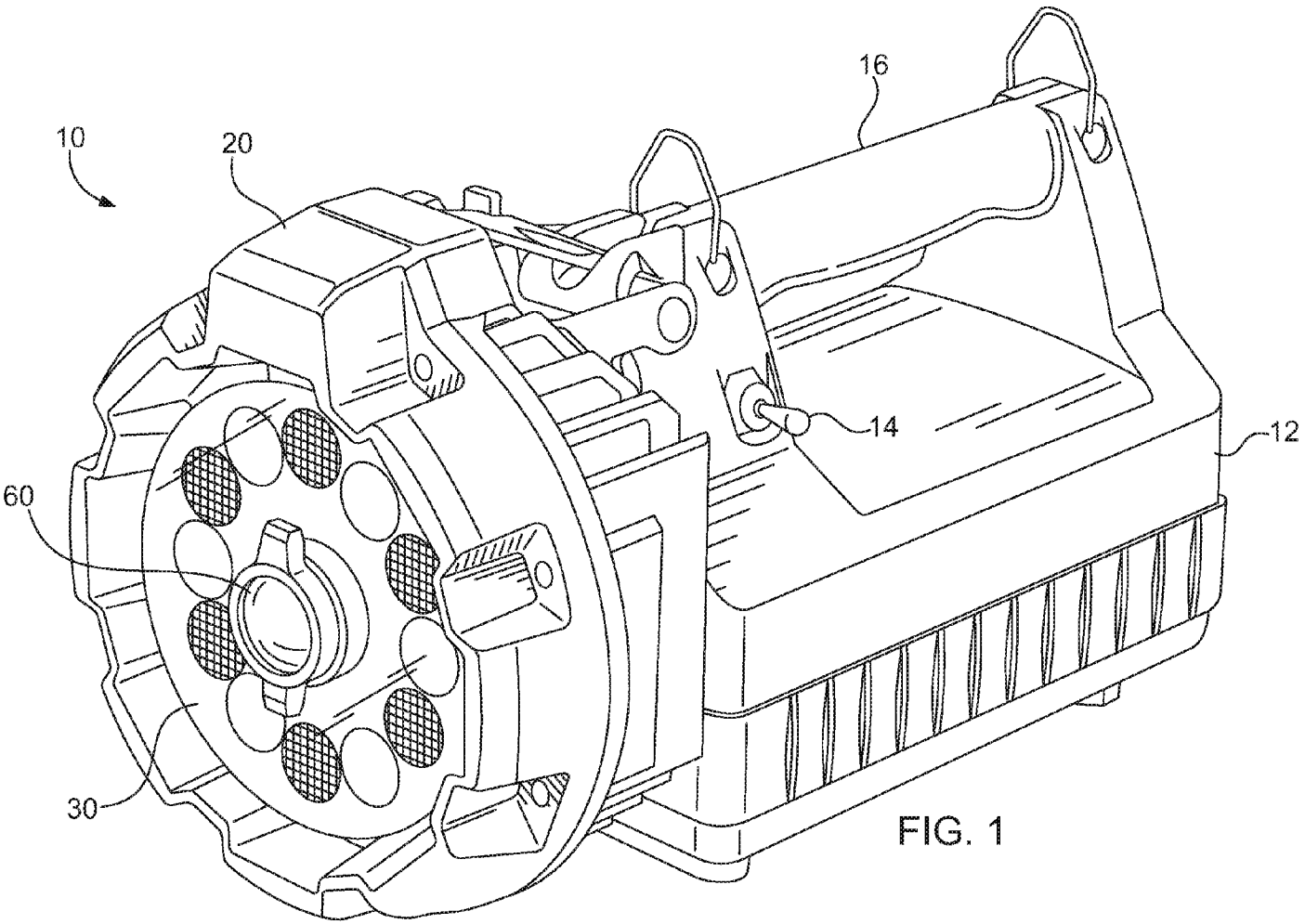
FIG. 1 is a perspective view of a portable light.
Figure 2:
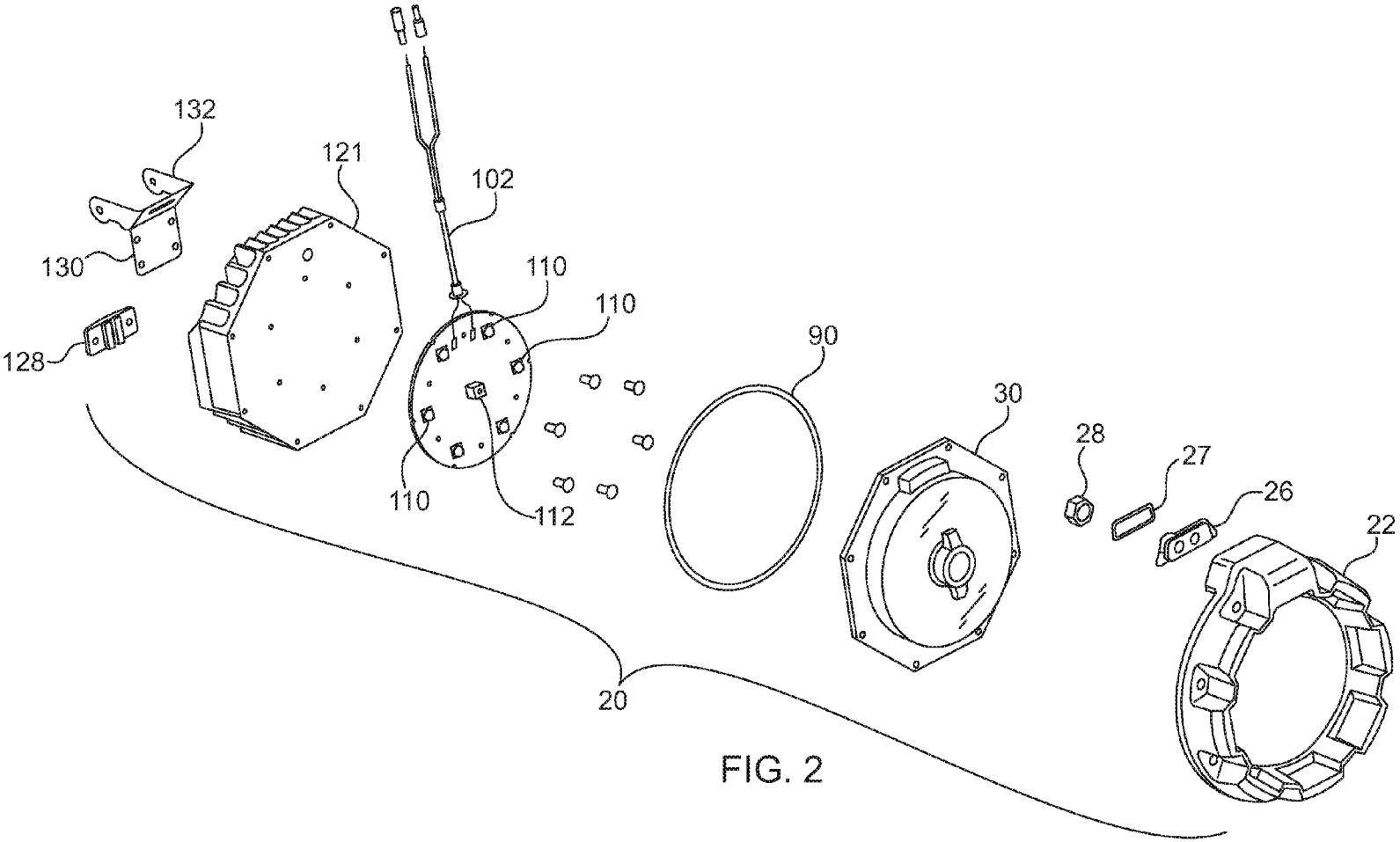
FIG. 2 is an exploded perspective view of a head of the portable light illustrated in FIG. 1.

Referring now to the figures in general, wherein like elements are numbered alike throughout, a portable light is designated generally 10. Referring to FIGS. 1-2, the light 10 may be any of a variety of battery powered light, such as a flashlight or lantern. In the present instance, the light 10 is a lantern. A lamp head 20 connected to the housing 12 has one or more light elements 110. In the present instance, the lamp head 20 includes a diffuser 40 for selectively diffusing the light element(s) so that the operator can switch the light between a focused beam and a diffuse light source.

Referring to FIG. 1, the lantern includes a housing 12 having a hollow interior compartment for housing a power source, such as a battery that may be disposable or rechargeable. The housing may be configured in a variety of shapes, such as a cylindrical housing. However in the present instance the housing comprises a body that is shaped similar to a rectangular prism and has a handle 16 connected to and spaced apart from the body. A pair of strap loops may also be provided for attaching a strap to the housing so that the operator can carry the light 10 by the strap. Although the light 10 may be controlled by any of a number of switches or actuators, in the present instance, the light 10 includes a switch 14, such as a toggle switch for turning the light on and off.

Figure 4:
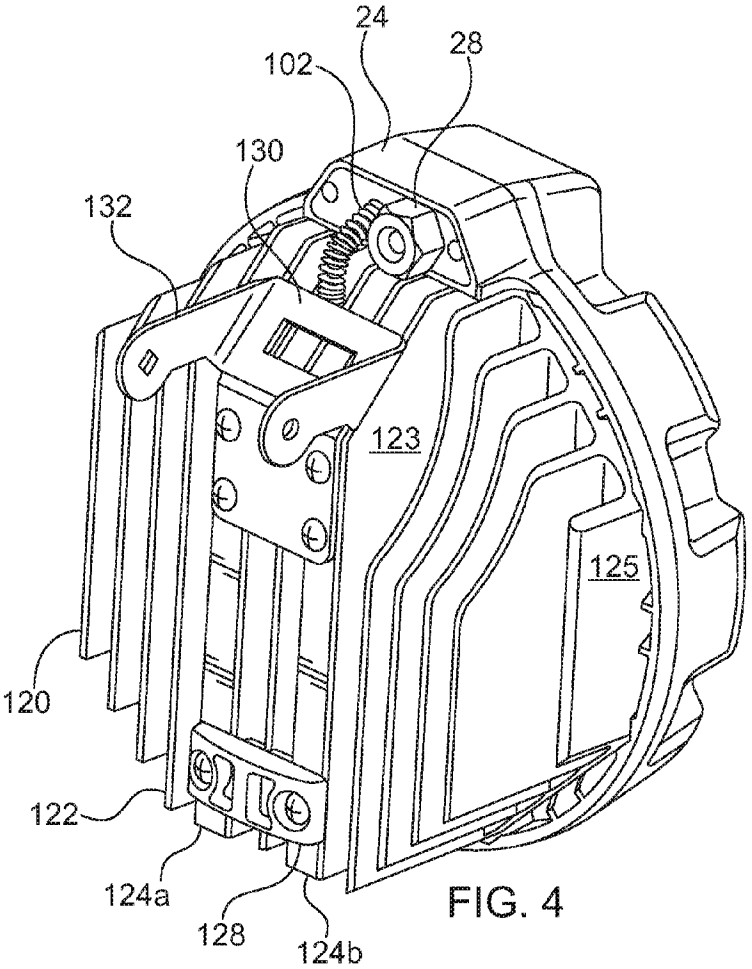
FIG. 4 is an enlarged perspective view of the light head illustrated in FIG. 2, shown from a reverse angle.
Figure 3:
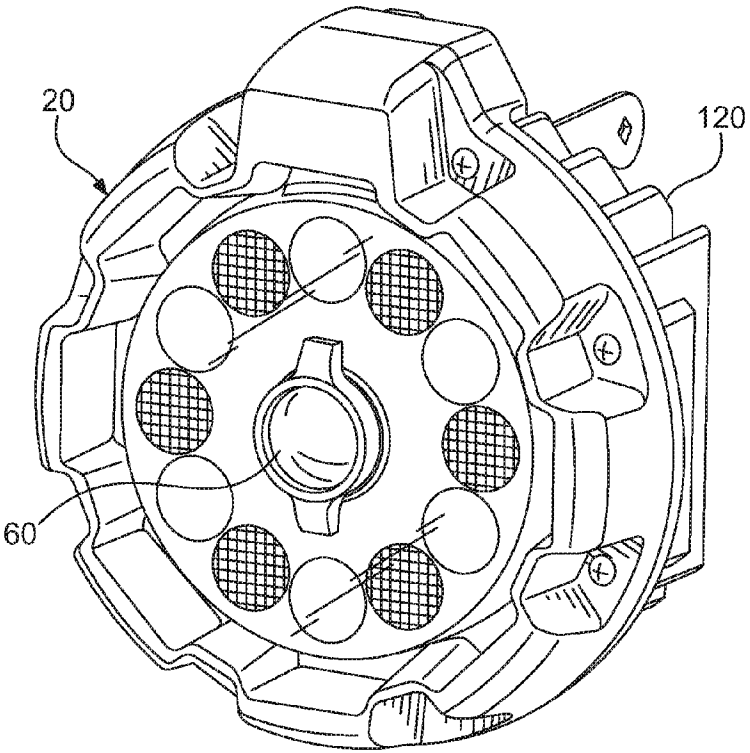
FIG. 3 is an enlarged perspective view of the light head illustrated in FIG. 2.

Referring to FIGS. 1-5, the lamp head 20 may be rigidly connected to the housing 12, however, in the present instance, the lamp head 20 is pivotably connected with the housing. Specifically, a bracket 130 provides a pivotable connection between the lamp head 20 and the housing 12. Referring to FIGS. 2 and 4, the mounting bracket 130 is rigidly connected to a heat sink 120 so that the heat sink does not move relative to the bracket. The mounting bracket 130 comprises a yoke 132 formed by parallel arms that project away from the rearward end of the heat sink 120. The yoke 132 comprise a pair of axially aligned apertures so that a pivot pin can pass through the holes and form a pivot axis for the head, so that the head is pivotably connected with the housing.

As shown in FIGS. 2 and 4, the light 10 comprises a heat sink 120 having a plurality of elongated fins 122 extending away from a generally planar base 121. The fins are vertically oriented and substantially parallel so that slots are formed between adjacent fins. As shown in FIG. 4, fins 123 are the longest and deepest fins. Moving toward the outer edges, the fins get progressively shorter and shallower so that the fins 125 adjacent the outer edge project outwardly from the base 121 less than half as far as the fins 123 near the middle of the heat sink.

In the present instance, the heat sink is formed so that a plurality of the fins are interconnected by bridges 124 that span two or more fins. Specifically, the outer end (i.e. the end remote from the base 121) of two adjacent fins 123 near the middle of the heat sink are connected by bridge 124*a* that spans between the two fins along the length of the fins. Similarly, a second pair of fins are interconnected or capped by a second bridge 124*b* that spans between the outer edges of the fins similar to bridge 124*a*.

As shown in FIG. 4, the mounting bracket 130 is connected directly to the bridge 124*a* and 124*b*. Specifically, the mounting bracket spans between bridge 124*a* and bridge 124*b* and is fixed to the bridges. In the present instance, the bracket is connected directly to the bridges by a mechanical fastener, such as a screw, bolt or other know fastener.

As shown in FIG. 4, if the lamp head 20 is pivotably connected with housing 12, it may be desirable to include a cushion or elastomeric pad to cushion and contact between the head and the housing. In the present instance, an elastomeric bumper 128 is connected to the rearward end of the heat sink. More specifically, the bumper is connected to the bridges 124*a*, 124*b* by a mechanical fastener such as a screw, bolt or other known fastener.

Referring now to FIG. 2, the lamp head 20 comprises a face plate 22 a lens/reflector subassembly 30 a PC board 100 and a heat sink 120. The PC board 100 is nested within the lens/reflector subassembly 30, which in turn in nested within the facecap 22. The facecap 22, lens subassembly 30 and PCB 100 are then mounted onto the heatsink 100.

Figure 5:
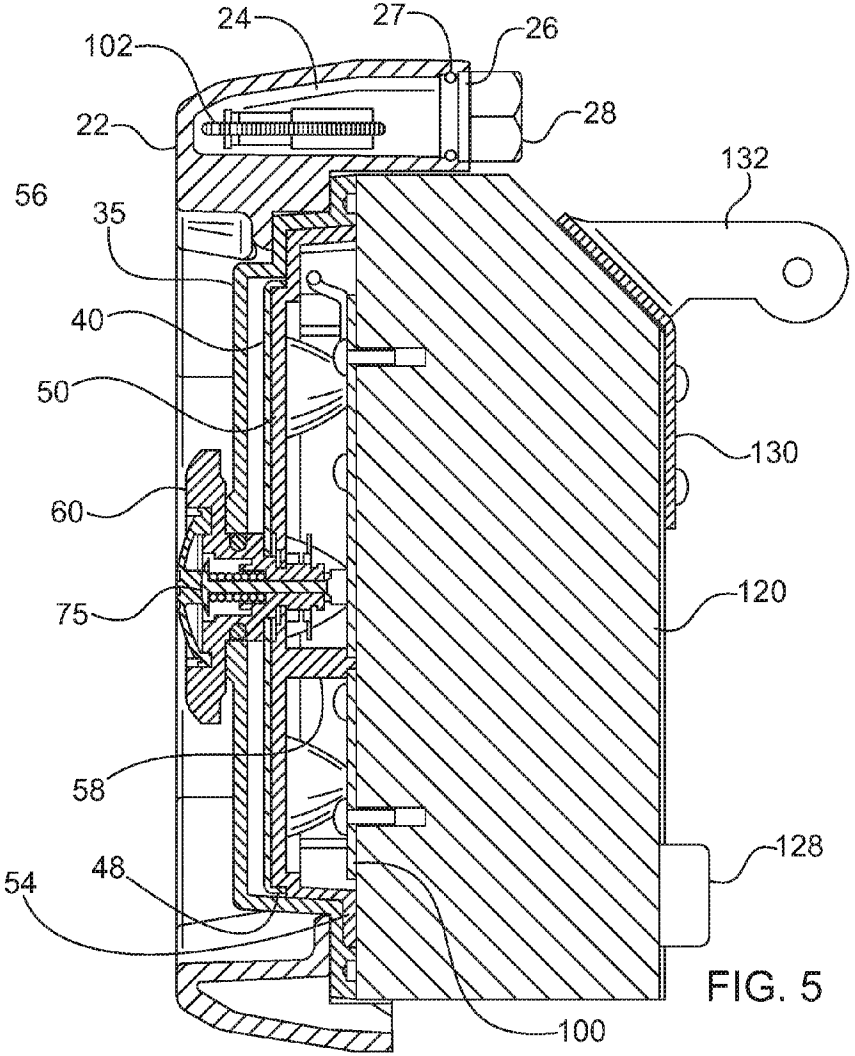
FIG. 5 is an enlarged cross-sectional view of the light head illustrated in FIG. 2.

As shown in FIG. 5, the facecap 22 comprises a generally hollow ring shape having an opening sized to receive the lens subassembly 30. The inner diameter of the face cap 22 comprises a pair of counterbores that form shoulder against which the lens assembly abuts. A compartment 24 is formed in the upper end of the face cap. The compartment 24 is configured to provide a junction box for an electrical connection between the housing 12 and the lamp head 20. As shown in FIGS. 2 & 5, electrical leads 102 connected with the PCB 100 extend into the compartment 24. A cover 26 closes the opening to the compartment and a seal 27 provides a fluid tight fit. An aperture extends through the cover to provide access for an electrical connection from the housing. Additionally a sealing element provides a fluid-tight seal between the compartment and the housing electrical connection. For instance, a compression nut may provide a fluid-tight seal between the chamber 24 and electrical leads from the housing.

Figure 6:
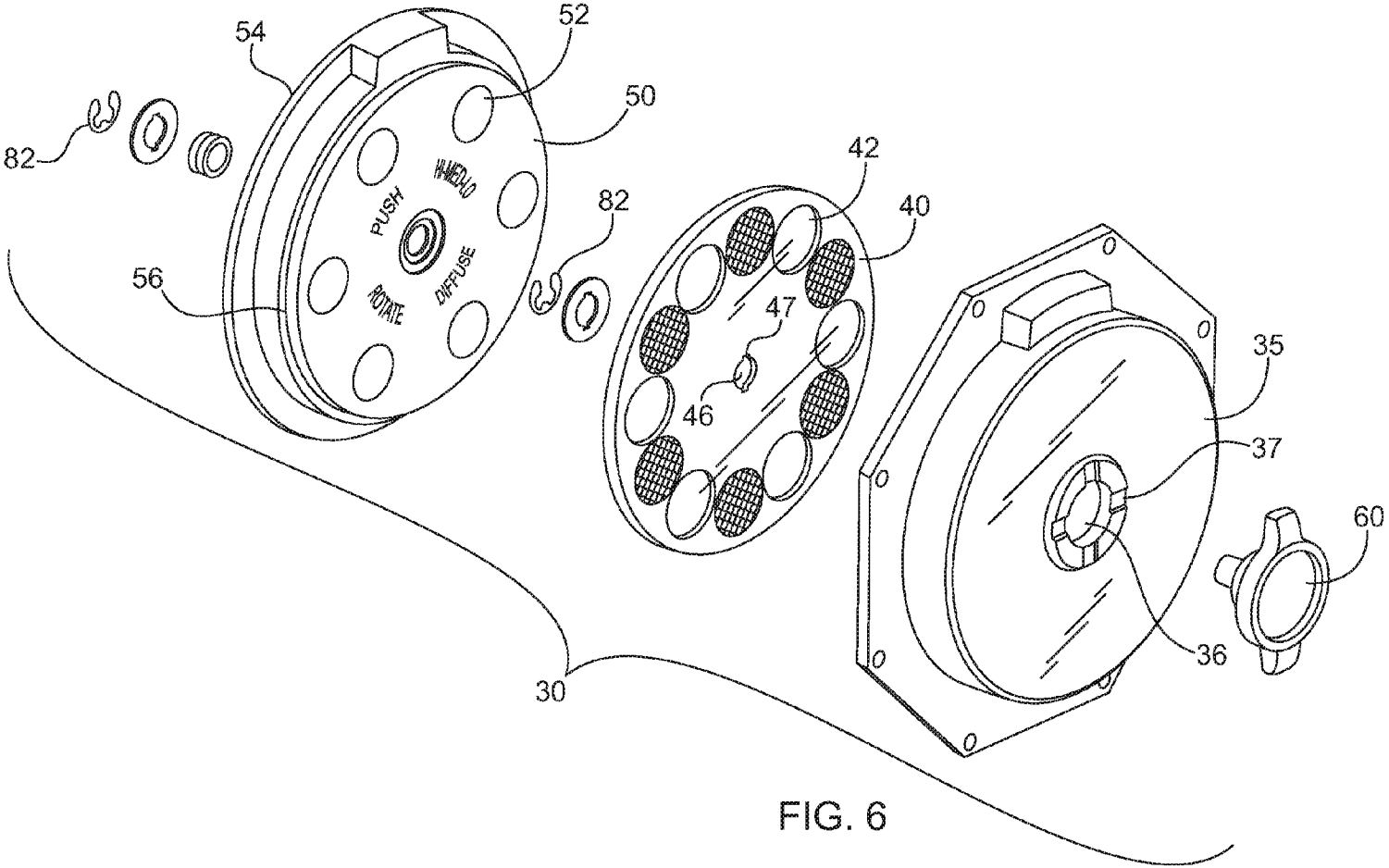
FIG. 6 is an exploded perspective view of a lens assembly of the light head illustrated in FIG. 2.

Referring now to FIG. 6, the details of the lens/reflector subassembly will be described in greater detail. The lens subassembly comprises a lens 35, a diffuser 40, a reflector and an actuator 60. The lens may be formed of a variety of transparent or translucent materials such as glass or plastic. However, in the present instance, the lens 35 is formed of high impact clear plastic. The lens 35 comprises a circumferential flange that extends outwardly away from the body of the lens to provide a flange to attach the lens to the heat sink 120. The lens 35 has a central opening 36 configured to receive the actuator knob 60 used to operate the diffuser and control the dimming of the light. An annular shoulder is formed around the central opening in the lens and a plurality of locating elements, such as recesses or notches 37 are formed in the shoulder adjacent the central opening. In the present instance, the locating elements comprise a plurality of recesses 37 circumferentially spaced about the central opening in the lens 35.

The diffuser 40 also may be formed of a variety of transparent or translucent materials. In the present instance, the diffuser comprises a translucent plastic disc. A circumferential flange extends inwardly around the disc thereby forming a lip 48 (shown in FIG. 5). The diffuser comprises an aperture forming a central opening 46. One or more locating features to locate the diffusion disc are formed at or adjacent the central opening 46. For instance, in the present instance, locating notches 4 or recesses 47 extend outwardly from the central opening. The notches cooperate with actuator 60 to locate the diffusion disc relative to the actuator.

Figure 11:
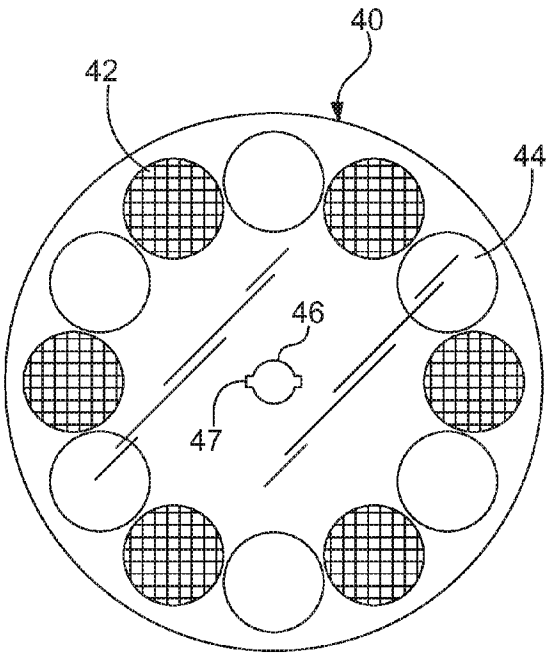
FIG. 11 is an enlarged side view of a diffuser of the light head illustrated in FIG. 2.
Figure 10:
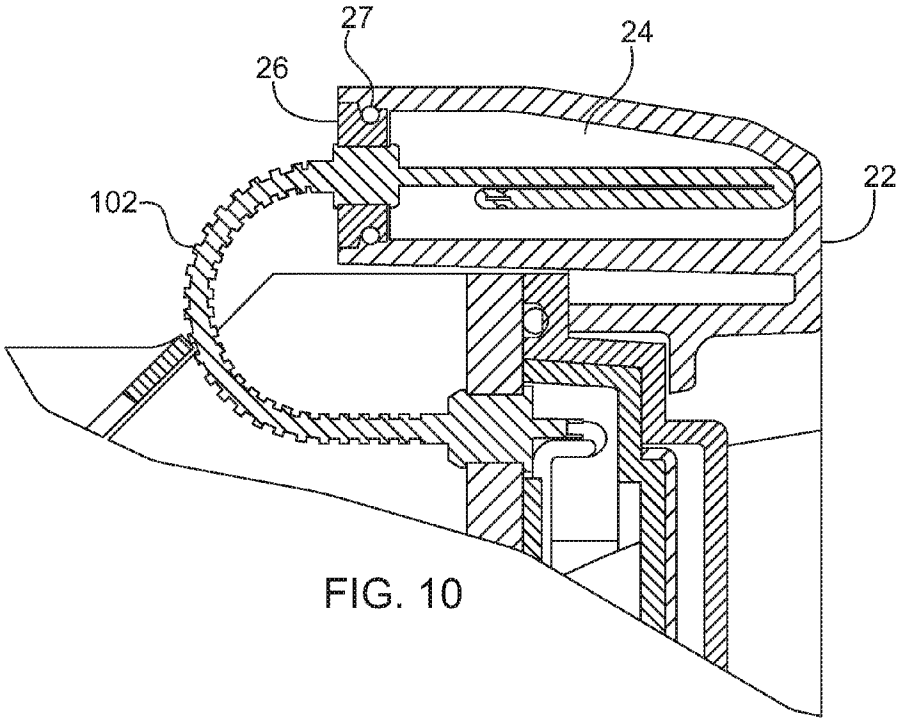
FIG. 10 is an enlarged fragmentary cross-sectional view of the light head illustrated in FIG. 2.

Referring to FIG. 11, the diffusion disc comprises a plurality of diffusion areas 42 and a plurality of non-diffusion areas 44. The diffusion and non-diffusion areas 42, 44 are spaced around the circumference of the disc. More specifically, the diffusion areas are spaced apart from one another and are equally spaced around the diffuser. The non-diffusion areas 47 are also spaced apart from one another and are equally spaced around the diffuser. Additionally, in the present instance, the non-diffusion areas are interposed between the diffusion areas so that the areas alternate between diffusing areas and non-diffusing areas.

Referring to FIG. 11, diffusing areas 42 and non-diffusing areas 44 are formed from different patterns that diffuse the light differently. Although the areas may be formed in a variety of patterns, in the present instance, each non-diffusing area 44 is a generally clear circular area substantially free from distortion. In particular, each non-diffusing area 44 is substantially similar. Although the diffusing areas 42 may be formed in a variety of patterns, in the present instance, the diffusion areas are circular areas with a contoured pattern, such as a honeycomb pattern formed in the surface of the diffuser. The honeycomb pattern creates surfaces that tend to scatter or diffuse the light. As with the non-diffusing areas, in the present instance, each diffusing area is substantially similar.

Referring to FIGS. 5-6, the reflector 50 comprises one or more concave reflective surfaces 52 for focusing the light from the light elements 110. In the present instance, the lamp head 20 comprises a plurality of light elements, so the reflector comprises a plurality of concave reflective surfaces spaced around the lamp head. Specifically, the reflector comprises a plurality of reflective surfaces spaced around the circumference of the reflector 50. Although the shape of the reflectors may vary, in the present instance, each reflective surface is a substantially similarly shaped parabolic concave surface. The base of each reflective surface forms an opening and one of the light elements 110 projects toward or into the opening. As shown in FIG. 6, the reflector 50 further comprises a circumferential flange 54 extending radially outwardly. The reflector further comprises a circumferential groove or recess 56 extending around the upper surface of the reflector. The reflector 50 includes a central opening that aligns with the central openings in the diffuser 40 and lens 30 so that the reflector 50, diffuser 40, and end cap 40 can be axially aligned.

Figure 7:
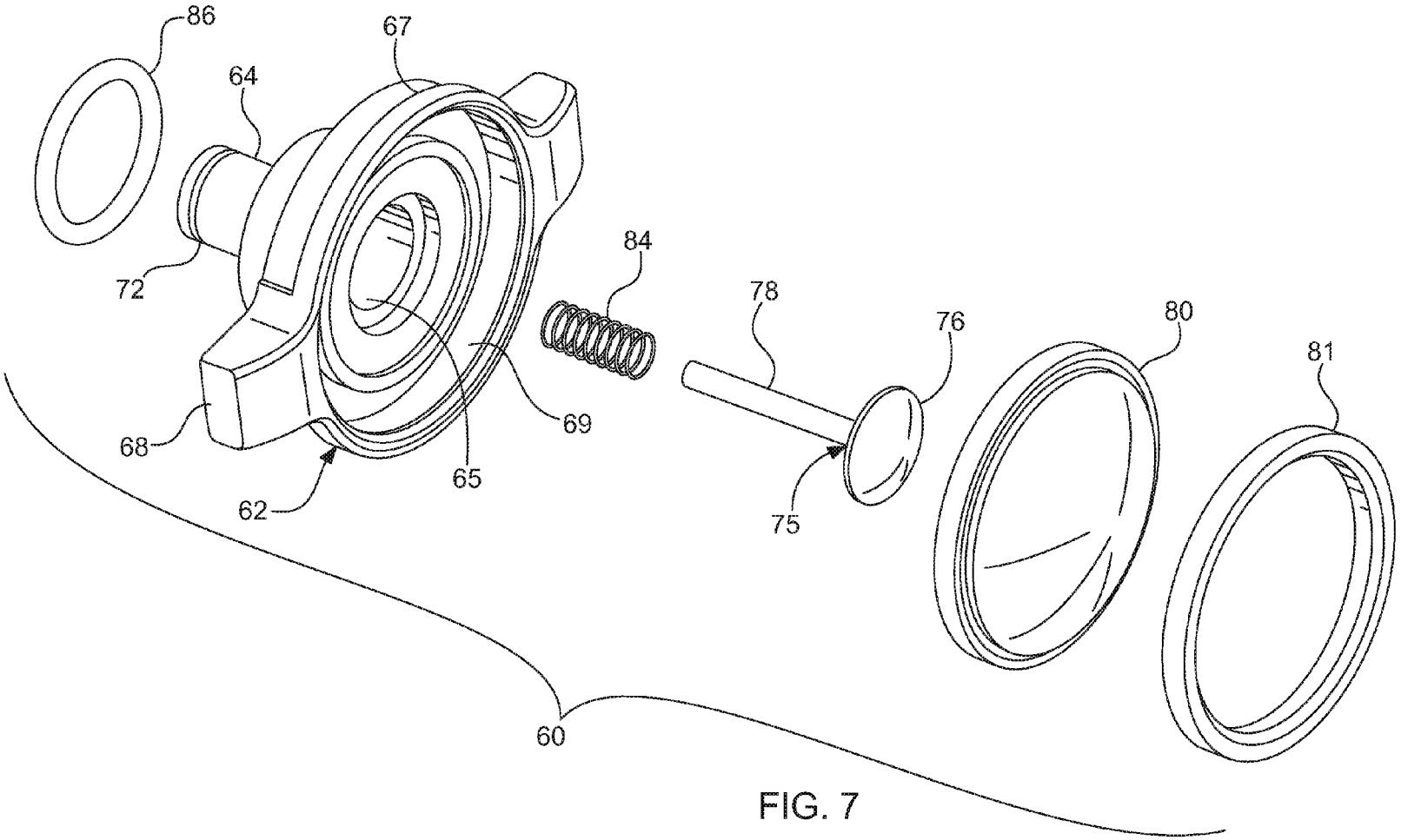
FIG. 7 is an exploded perspective view of a controller assembly for the light head illustrated in FIG. 2.
Figure 9:
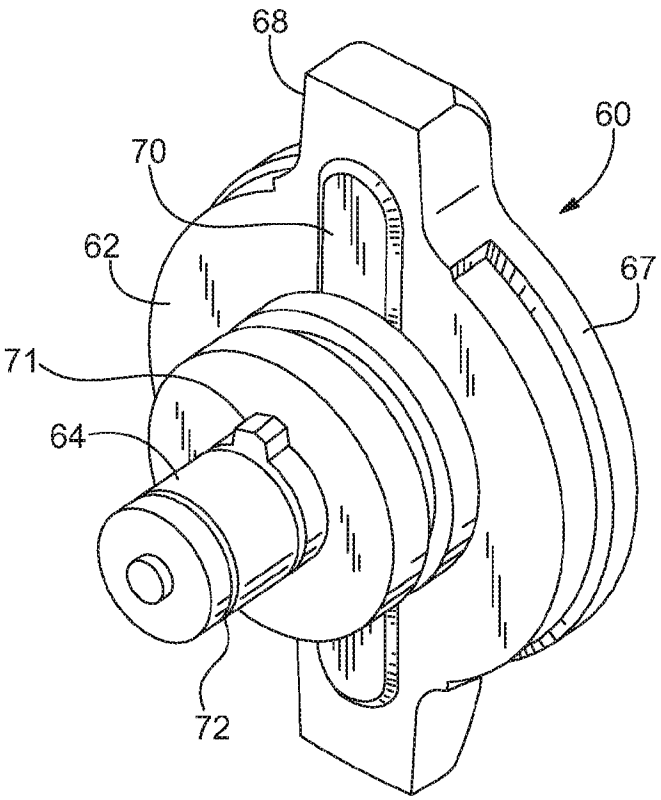
FIG. 9 is a perspective view of the controller assembly illustrated in FIG. 8.
Figure 8:
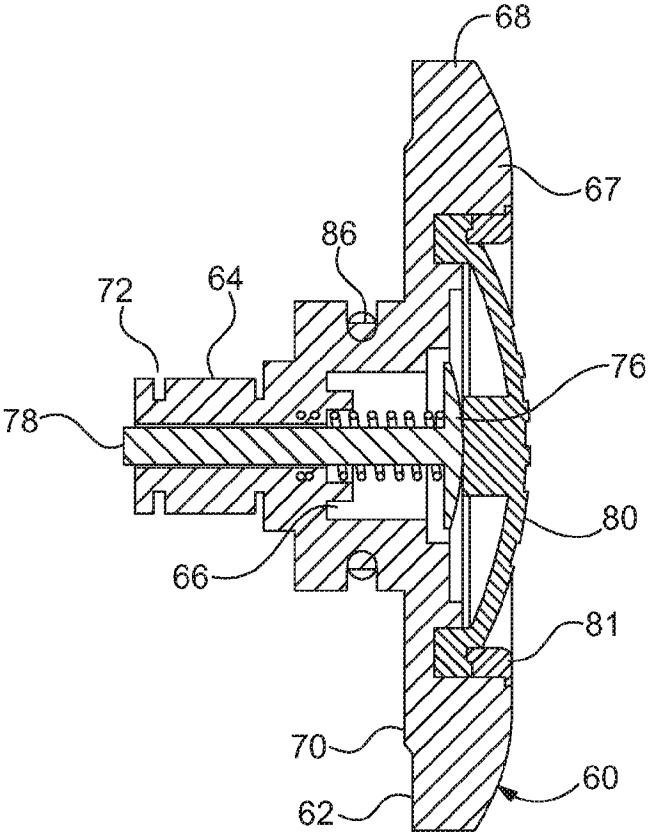
FIG. 8 is a cross-sectional view of the controller assembly illustrated in FIG. 7.

The lens subassembly 30 further comprises the actuator 60 that is operable to actuate the dimming function and to actuate the diffusion for the light. Referring to FIGS. 7-9, the details of the actuator subassembly 60 will be described in greater detail. As shown in FIG. 7, the actuator 60 comprises a rotatable knob 62 and a pushbutton dimmer actuator 75 nested within the rotatable knob.

The knob 62 comprises a generally cylindrical stem 64 projecting from an enlarged head 67. The enlarged head 67 is a generally circular hub with a plurality of eccentric lobes 68 projecting away from the circular hub. A bore 65 extends through the enlarged head 67 and the stem 64. Additionally, a counterbore 66 in the enlarged head intersects with and is coaxial with the bore 65. Furthermore, the counterbore 66 opens into an enlarged recess formed in the top of the enlarged head.

The stem 64 includes an enlarged diameter cylindrical portion configured to mate with the mounting apertures 36, 46 in the lens 35 and the diffuser 40. A circumferential groove around the stem forms a seat for a sealing element that maintains the fluid-tight seal between the actuator 60 and the lens 30. In the present instance, the sealing element is an o-ring 86. Additionally, a pair of grooves, such as snap ring grooves 72 are formed around the stem 64 for connecting the stem with the lens 35, diffuser 40 and reflector 50 as discussed further below.

Referring to FIG. 9, the knob comprises a plurality of locating elements configured to cooperate with the lens 35 and diffuser 40. Specifically, the underside of the enlarged head 67 comprises a pair of elongated ridges or ribs 70 that extend along the lobes 68. The ridges 70 are configured to mate with the recesses 37 formed around the opening in the lens 35. Specifically, the ridges 70 are configured so that the ridges can be aligned with and seated in the notches 37 in the lens. In this way, the cooperating ridges and recesses will impede movement of the actuator 60 relative to the lens.

The knob 62 also includes locating tabs 71 formed on the stem 64. The locating tabs are configured to mate with the locating notches 47 formed in the central aperture of the diffuser 40. In this way, the locating tabs 71 key into the diffuser notches 47. The cooperating locating tabs 71 and notches 47 impede rotational movement of the actuator relative to the diffuser 40.

The rotatable knob 62 houses the dimmer actuator 75 that is actuable to dim the light level for the LEDs in the light. The dimmer actuator 75 comprises an elongated stem 78 and an enlarged head 76. The stem 78 is configured to slide within the central bore 65 of the knob 62. Specifically, in the present instance, the dimmer actuator is inserted into the bore 65 of the actuator knob so that the stem of the dimmer actuator is coaxial with the stem 64 of the knob. A biasing element, such as a coil spring 84 is seated within the counterbore 66 in the knob so that the biasing element biases against the head of the dimmer actuator 75. A flexible dome, such as a rubber boot 80 covers the enlarged recess 69 in the knob 62 and retains the dimmer actuator within the knob as shown in FIG. 8. A retaining ring 81 is fixed to the walls of the enlarged recess 69 in the knob 62 to fix the dome in place over the dimmer actuator 75.

Referring again to FIG. 6, the actuator 60 is connected to the lens 35, diffuser 40 and reflector 50 as follows. The stem 64 of knob 62 is inserted through the central apertures 36, 46 of the lens 35 and diffuser 40. The knob 62 is then fixed to the diffuser 40 by a connector. For instance, a washer shaped like the profile of the stem 64 is mounted onto the end of the stem and a retaining ring such as an e-ring 82 is snapped into the snap ring groove 72 farthest from the end of the stem. The e-ring 82 locks the actuator 60, lens 35 and diffuser 40 together by substantially limiting axial displacement of the lens relative to the knob 62 and the diffuser 40.

After connecting the knob 62 with the lens 35 and diffuser 40, the stem 64 of the knob is inserted into the central opening in the reflector 50. A second retaining ring, such as an e-ring 82, is snapped into the snap-ring groove 72 near the end of the stem 64. In this way, the outer surface of the stem 64 mates with the inner surface of the openings in the lens 35, diffuser 40 and reflector 50 to axially align the lens, diffuser and reflector with one another.

Referring again to FIG. 2, the PCB 100 may be fixedly connected to the heat sink 120 by any of a variety of connections, such as mechanical connectors or chemical connectors, such as epoxy. However, in the present instance, the heat sink 120 comprises elements for mechanically aligning and connecting the PCB 100 to the heat sink. Specifically, the heat sink 120 includes a plurality of spaced apart threaded sockets in the base 121 of the heat sink. A plurality of holes are formed in the PCB that align with the threaded sockets in the base of the heat sink 120. Once aligned, the PCB 100 is connected to the heat sink with a plurality of connectors such as screws.

The heat sink 120 further comprises a plurality of threaded sockets for aligning the lens subassembly 30 with the PCB 100. After the PCB is aligned with and fixed to the heat sink as discussed above, the lens assembly 30 is fixed to the heat sink, thereby aligning the lens assembly with the PCB 100, which in turn aligns each of the light elements 110 with the corresponding parabolic reflective surfaces 52 of the reflector 50. Specifically, the facecap 22 is aligned with the lens assembly 30 and connected to the heat sink with a plurality of connectors, such as screws. The screws extend through the facecap, through holes in the flange of the lens assembly and into the threaded sockets in the heat sink.

In addition to aligning the reflector with the light elements 110 on the PCB 100, connecting the elements as described above also aligns the actuator 60 with a switch 112 on the PCB used to control the dimming of the light. Specifically, the dimmer actuator 75 is aligned with the switch 112 so that pressing the dimmer actuator actuates the switch. As described further below, the switch 112 is connected with a controller 220 that controls the operation of the light. The controller 220 dims the light in response to actuation of the switch 112.

As shown in FIG. 5, when the lens assembly 30 is mounted to the heat sink, it may be desirable to seat a sealing element 90 between the lens assembly and the heat sink to provide a fluid-tight seal between the lens assembly and the heat sink. In the present instance, the sealing element is an o-ring 90 extending around the circumference of the flange on the lens.

Configured as described above, the actuator 60 is operable to control the diffuser 40 and the dimmer switch. More specifically, the diffuser is operable to vary how the light from the light elements is diffused. In a first position, the diffusion surfaces 42 are aligned with the light elements so that the diffusion surfaces overlie the parabolic reflective surfaces 52. In this position, the light from the light elements 110 projects through the first diffusion surfaces 42 so that the light is diffused. If the operator desires to have a more focused or coherent beam of light, the operator moves the diffuser to a second position in which the non-diffusing surfaces are aligned with the light elements.

To move the diffuser to the second position, the operator pulls on the enlarged head 67 of the actuator to displace the actuator axially outwardly away from the lens 35. As shown in FIG. 5, a gap separates the diffuser 40 from the inner wall of the lens 35 so that the actuator can be pulled outwardly to unseat the ridge 70 of the actuator from the notches 37 in the lens. The operator then rotates the actuator 60 to rotate the diffuser 40 to the second position. The locating tabs 71 on the actuator cooperate with the notches 47 in the diffuser so that rotating the actuator rotates the diffuser. The ridges in the enlarged heard seat into the next set of notches in the lens to ensure that the diffuser is aligned with the second position in which the non-diffusing surfaces are aligned with the parabolic reflective surfaces.

In addition to controlling the diffuser, the actuator 60 is operable to control the dimming by pressing the dimmer actuator 75. Specifically, when the operator presses the flexible dome 80, the operator drives the dimmer actuator downwardly against the bias of spring 84. The stem 78 of the dimmer actuator 75 actuates switch 112 (shown in FIG. 2), thereby dimming the light. In the present instance, the light is configured so that repeatedly pressing the dimming actuator 75 cycles the light through a series of dim level. For instance, the first actuation dims the light to 75% illumination, the second actuation within a predetermined time frame dims the light to 50% illumination and a third actuation within a predetermined time frame dims the light to 25% illumination. It should be understood that this is simply an example of how multiple dim levels can be actuated. The light can be configured to have as few as one dim level actuated by the dimmer switch or the light can have more than 3 dim levels.

Figure 12:
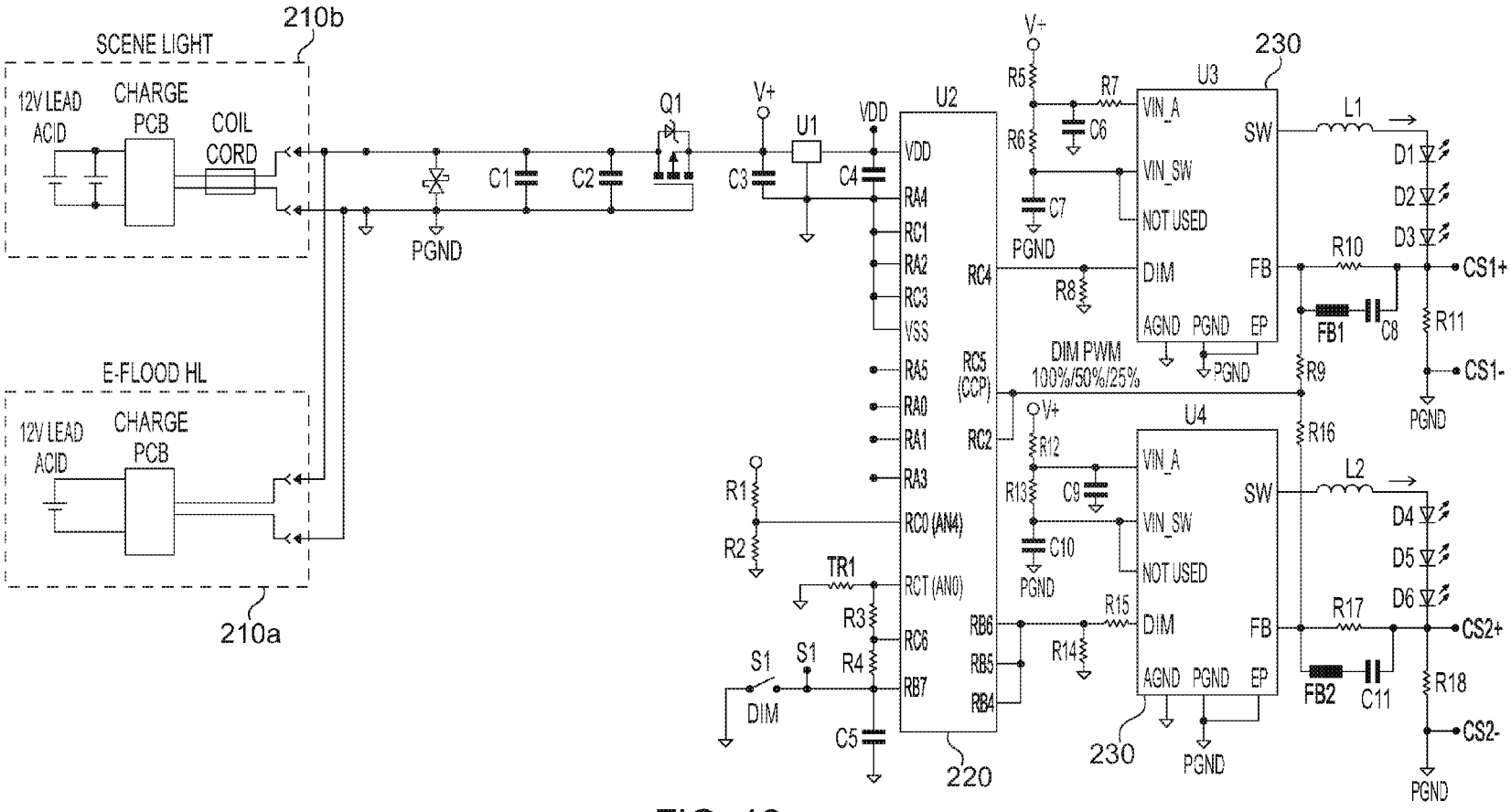
FIG. 12 is a schematic drawing of a control circuit of the light illustrated in FIG. 1.

The operation of the light may be controlled by any of a number of control circuits. However, in the present instance, an electronic controller 200 controls the operation of the light in response to signals received from the toggle switch 14 and the dimmer actuator 75. Referring to FIG. 12 the details of the controller will be described in greater detail.

As described above, the light 10 includes a lamp head 20 fixedly connected to the battery housing 112. However, it may be desirable to releasably connect the lamp head 20 with the housing 12 so that the lamp head can be extended away from the battery housing. In such a configuration, the light includes an elongated power cord extending between the lamp head and the battery. FIG. 12 illustrates that the light can be configured with a lamp head fixedly connected with the battery housing or releasably connected with the battery housing. Specifically, in FIG. 12, power source 210*a* reflects a configuration in which the light is powered by a battery housed within the housing adjacent the lamp head 20. Power source 210*b* reflects a configuration in which the light is powered by a battery connected with the lamp head by an elongated coil so that the lamp head is not adjacent the casing in which the battery is housed.

As noted above, in the present instance, the light is controlled by a controller 220 such as a microprocessor or microcontroller. For example, as shown in FIG. 12, the controller 220 is a microcontroller such as a 20-pin CMOS microcontroller. The controller 220 receives signals from the toggle switch 14 and the dimmer switch 112 and controls the power to the light head in response to the signals received from the switch. For instance, dimmer switch 112 is designated switch S1 in FIG. 12 is in circuit with the controller. When the controller receives a signal indicating that S1 is closed, the controller controls the dimming of the light.

The controller 220 may control the dimming in one of a variety of known mechanisms for dimming LEDs. For instance, the light 10 may include one or more LED drivers. In the present instance, the light includes a pair of LED regulators designated 230 in FIG. 12. The regulators may be any of a variety of regulators, however, in the present instance, the regulators 230 are 850 step-down DC-DC buck current regulators. The regulators are designed to operate as a constant current source, so the lights may be dimmed by pulsing the lights on and off. In this way, the level of dimming is determined by the percentage of pulses that the light is on versus off.

Alternatively, in the present instance, the system uses analog dimming, such as by controlling the current to the LEDs. Specifically, the controller controls the dimming by reducing the current to the LEDs. However, the system provides a closed loop feedback to ensure that the regulators 230 detect a constant current at the FB input. In particular, to dim the LEDs, the controller reduces the current to the LEDs. At the same time the controller increases the voltage of the pulse train from pins 5, 14 as the dimming increases. As a result, the system provides a DC voltage offset so that FB of the regulator 230 receives a 100 mV signal regardless of the reduced current at the LEDs. More specifically, the voltage across R10 and R11 sum at FB so at a 50% dim level, 50 mV cross R10 and 50 mV cross R11 so that FB sees 100 mV.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A portable light, comprising:

a housing having a battery compartment;

a light head connected with the housing, wherein the light head comprises:

a plurality of light elements spaced apart from one another;

a reflector comprising a plurality of reflective surfaces, wherein each light element is disposed within one of the reflective surfaces so that the reflective surfaces focus the light from the light element disposed within the respective reflective surface;

a displaceable diffuser for selectively diffusing the light from the light elements, wherein the diffuser comprises a plurality of first areas having a first dispersal pattern and a plurality of second areas having a second dispersal pattern different from the first pattern;

wherein the first and second areas are spaced about the diffuser so that in a first position the first areas of the diffuser overlie the reflective surfaces so that the light from the light elements projects through the first areas, and wherein when the diffuser is in a second position, the second areas of the diffuser overlie the reflective surfaces so that the light from the light elements projects through the second areas;

a controller operable to control the light elements so that when the diffuser is in the first position the light elements provide a full light level and when the diffuser is in the second position the light elements provide a dim light level that is less than the light provided by the full light level;

an actuator operable to displace the diffuser from the first position to the second position, wherein the actuator comprises a first switch actuable by the actuator, wherein the controller controls the light between the full light level and the dim light level in response to actuation of the first switch.

2. The portable light of claim 1 comprising a battery within the battery compartment.

3. The portable light of claim 1 wherein the actuator is operable to rotate the diffuser from the first position to the second position.

4. The portable light of claim 3 wherein the first switch is a linearly actuable switch.

5. The portable light of claim 4 wherein the actuator comprises a rotatable knob for controlling the diffuser and the first switch is a push button switch.

6. The portable light of claim 5 wherein the first switch and the knob are coaxially mounted.

7. The portable light of claim 1 wherein the first dispersal pattern comprises a contoured pattern for diffusing the light created by the light elements and the second dispersal pattern comprises a surface substantially free of contours to prevent diffusion of the light.

8. The portable light of claim 1 wherein the light elements are spaced around a central axis.

9. The portable light of claim 8 wherein the light elements are equally spaced about the circumference of a circle formed around the central axis.

10. The portable light of claim 1 comprising a second switch operable independently of the first switch to turn the light elements on and off.

11. The portable light of claim 4 wherein the switch comprises a biasing element.

12. The portable light of claim 1 comprising a releasable locking mechanism for releasably locking the actuator in the first position or the second position.

13. The portable light of claim 12 wherein the releasable locking mechanism comprises a detent.

14. The portable light of claim 12 wherein the actuator is linearly displaceable to release the actuator so that the actuator can be rotated to actuate the light between the full light level and the dim light level.

* * * * *